US006382912B1

(12) United States Patent
Lee et al.

(10) Patent No.: US 6,382,912 B1
(45) Date of Patent: May 7, 2002

(54) CENTRIFUGAL COMPRESSOR WITH VANELESS DIFFUSER

(75) Inventors: Yu-Tai Lee, McLean, VA (US); Thomas W. Bein, Annapolis, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 23 days.

(21) Appl. No.: 09/679,604

(22) Filed: Oct. 5, 2000

(51) Int. Cl.[7] ..... F04D 29/42
(52) U.S. Cl. ..... 415/224.5
(58) Field of Search ..... 415/224.5, 226, 415/211.2, 208.3, 211.1

(56) References Cited

U.S. PATENT DOCUMENTS

| | | | | | |
|---|---|---|---|---|---|
| 3,658,437 | A | * | 4/1972 | Soo | 415/224.5 |
| 3,759,627 | A | * | 9/1973 | Ehlinger | 415/224.5 |
| 4,181,466 | A | * | 1/1980 | Owen | 415/224.5 |
| 4,579,509 | A | * | 4/1986 | Jacobi | 415/224.5 |
| 4,900,225 | A | * | 2/1990 | Wulf et al. | 415/224.5 |

OTHER PUBLICATIONS

International Journal of Rotating Machinery, vol. 5, No. 4, entitled "Performance Evaluation of an Air–Conditioning Compressor" pp. 241–250, 1999.

International Gas Turbine & Aeroengine Congress & Exhibition held in Munich Germany, May 8–11,2000 entitled Direct Method for"Optimization of a Centrifugal Compressor Vaneless Diffuser".

* cited by examiner

*Primary Examiner*—F. Daniel Lopez
*Assistant Examiner*—Igor Kershteyn
(74) *Attorney, Agent, or Firm*—Jacob Shuster

(57) ABSTRACT

A centrifugal compressor or pump has a vaneless diffuser within which a radially extending passage is formed between a fixed plate surface and a profile contoured shroud surface establishing a pinch point location of minimum passage area intermediate inlet and outlet ends of the diffuser passage. Convergent and divergent flow portions of the diffuser passage respectively extend to and from the pinch point to establish continuous convergent flow from the inlet end and divergent flow toward the outlet end for exit outflow at a flow angle less than that of a convergent inflow angle from the inlet end imposed along an initial profile segment.

7 Claims, 2 Drawing Sheets

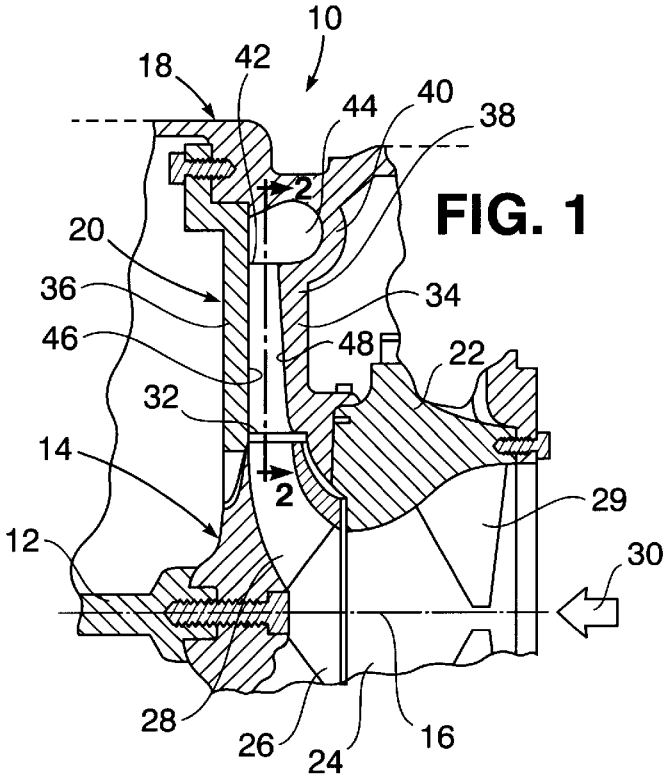
FIG. 1
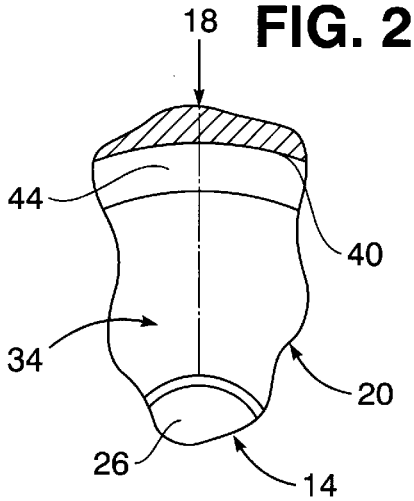
FIG. 2
FIG. 4
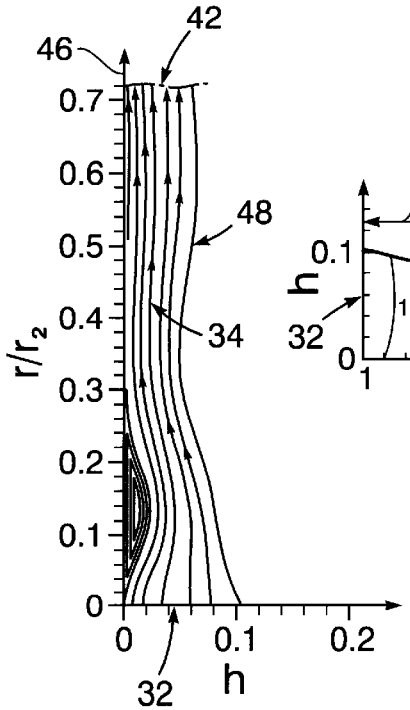
FIG. 3
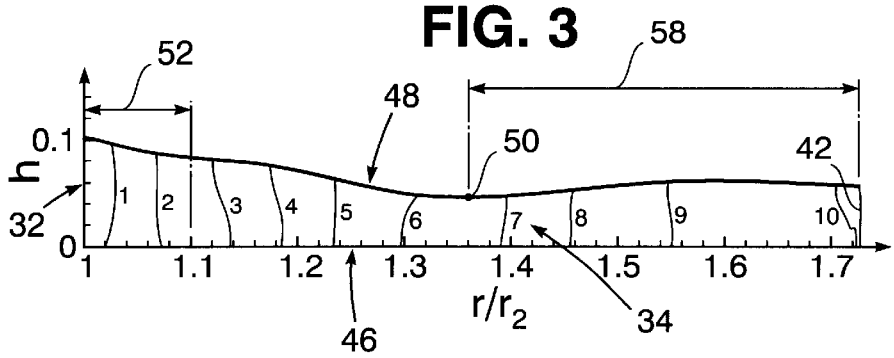

CENTRIFUGAL COMPRESSOR WITH VANELESS DIFFUSER

The present invention relates to a vaneless diffuser type of centrifugal compressor and pump.

BACKGROUND OF THE INVENTION

Vaneless diffusers of centrifugal compressors as generally known in the art are useful for refrigerant pumping purposes in an air-conditioning system, such as those on-board U.S. Naval marine vessels. A conventional type of centrifugal compressor/pump having a vaneless diffuser includes a power driven impeller through which inflow of the refrigerant under suction pressure is induced for radially outward inflow into the vaneless diffuser from which outflow of the refrigerant is delivered for discharge. The vaneless diffuser in such a centrifugal compressor maybe of the annular passage type, wherein a wall surface of a fixed plate is axially spaced from a shaped wall surface of a shroud to form a radial flow passage having a lower inlet end receiving the impeller outflow and a radially outer outlet end from which outflow occurs into a discharge passage of the compressor volute that is circumferentially divergent for example. Fluid kinetic energy is converted by such diffuser of the compressor into a static-pressure rise in the refrigerant by convergent passage flow from the passage inlet end toward the exit portion of the passage at its outlet end. Flow separation from the wall surfaces of the diffuser passage occurs, dependent on the fluid pressure rise to adversely affect operational stability and efficiency.

It is therefore an important object of the present invention to improve operational stability and efficiency of the foregoing type of compressor by achieving higher pressure recovery and lower non-recovery losses for the entire compressor operating range.

SUMMARY OF THE INVENTION

In accordance with the present invention, the diffuser shroud surface of a centrifugal compressor is contoured to provide for more efficient energy transfer during flow of fluid through a vaneless diffuser between its fixed surface and the shroud surface. The shroud surface contouring involves establishment of a shroud surface profile providing continuously converging flow passage from its inlet end to a location at a pinch point at which a minimum passage area is established. A divergent portion of the flow passage formed by the surface profile extends from the pinch point location to a location from which outflow completes the static fluid pressure rise for discharge from the diffuser outlet end into the volute portion of the compressor. Such outflow is effected at an exit angle less than that of the inflow convergence angle of the passage profile from the inlet end so as to accommodate a smooth diffuser outflow into the discharge passage formed in a volute portion of the compressor.

Contouring of the shroud surface profile is performed by optimizing calculations at plural locations along the fixed diffuser passage surface, based on diffuser and volute flow predictions. The procedure for such calculations based on flow predictions is set forth in two publications of Y. T. Lee et al. consisting of an article published in 1998 in "International Journal of Rotating Machinery" Vol. 5, No. 4, entitled "Performance Evaluation of an Air-Conditioning Compressor" on pages 241–250 and an article presented in the International Gas Turbine & Aeroengine Congress & Exhibition, held in Munich, Germany during May 8–11, 2000, such article being entitled "Direct Method for Optimization of a Centrifugal Compressor Vaneless Diffuser".

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein:

FIG. 1 is a partial side section of a centrifugal compressor having a diffuser configured in accordance with one embodiment of the present invention;

FIG. 2 is a partial section view taken substantially through a plane indicated by section line 2—2 in FIG. 1;

FIG. 3 is a graphical depiction of the profile associated with the shroud surface of the diffuser in the compressor illustrated in FIG. 1;

FIG. 4 is a graphical depiction of passage flow streams through the diffuser having its shroud surface contoured in accordance with the profile shown in FIG. 3;

DETAILED DESCRIPTION OF PREFERRED EMBODIMENT

Figure 5:
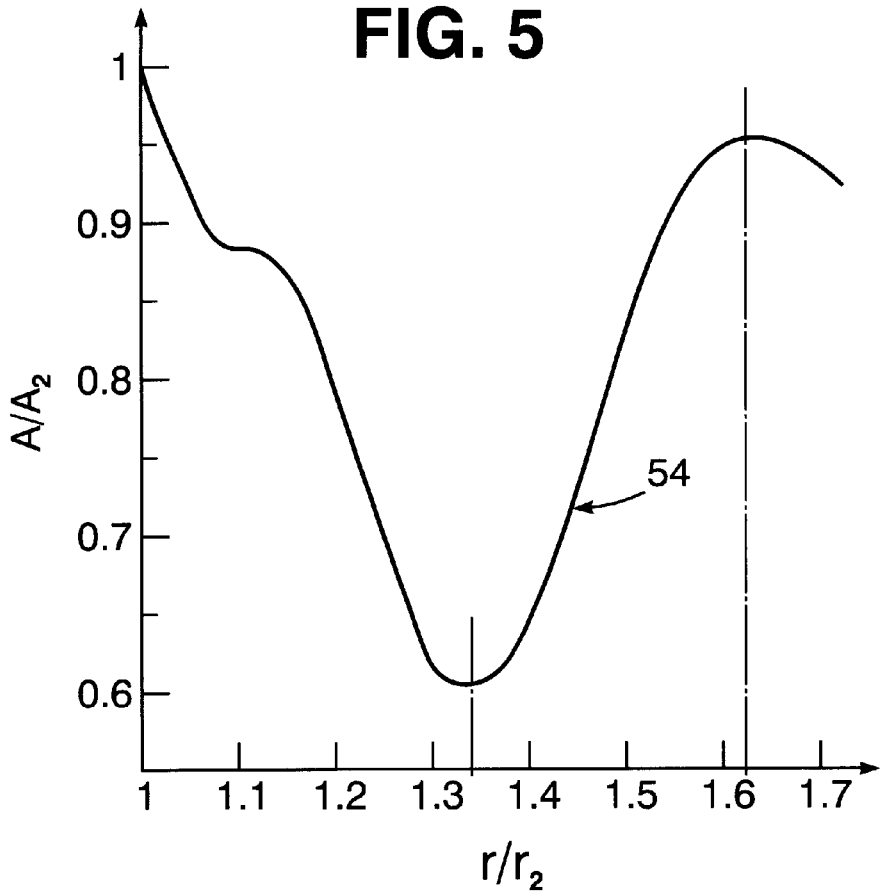
FIG. 5 graphically depicts the diffuser flow passage area corresponding to that of the shroud surface profile shown in FIG. 3.

Referring now to the drawing in detail, FIG. 1 illustrates a portion of a centrifugal compressor 10 having a power driven input shaft 12 connected to an impeller 14 supported for rotation about an axis 16 within an outer cylindrical housing 18 within which a vaneless diffuser 20 is fixedly mounted in operative relation to the rotatable impeller 14 and a stationary tubular inlet section 22 of the compressor 10. The inlet section 22 encloses a converging inlet passage 24 extending along the rotational axis 16 of the impeller 14 in close axially spaced relation to an annular passage 26 in the impeller 14 having radially extending vanes 28 therein. Radial guide vanes 29 connected to the inlet section 22 within passage 24 also project toward the axis 16 to control inflow 30 of fluid, such as the refrigerant of an air-conditioning system, under suction pressure produced in response to rotation of the impeller 14 imparted through its drive shaft 12 causing its vanes 28 to induce radial outflow of the fluid from the flow passage 24 through the annular impeller passage 26 into a lower inlet end 32 having a radius $r_2$ of a radially extending annular diffuser passage 34 formed within the vaneless diffuser 20 between its front plate 36 fixedly fastened to the housing 18 and an annular shroud 38 in the housing. The annular diffuser passage 34 terminates at a radially outer outlet end 42 from which outflow of the fluid exits into a volute 40 in the housing 18 having an annular discharge passage 44 of circumferentially divergent cross-section as shown in FIG. 2.

In accordance with the present invention, the annular diffuser passage 34 is formed between a fixed hub surface 46 on the front plate 36 and an optimizedly contoured confronting surface 48 on the shroud 38. Such contoured shroud surface 48 has a cross-sectional profile in varying relation to the plate surface 46 as graphically diagrammed in FIG. 3. As also shown in FIG. 3, located radially between the inlet and outlet ends 32 and 42 of the annular diffuser passage 34 along surfaces 46 and 48 is a pinch point 50 on the shroud surface profile. At the location of such pinch point 50 the passage area of the diffuser flow passage 34 between the surfaces 46 and 48 is minimum. Also a plurality of design stations between the passage inlet and outlet ends 32 and 42 are located along the profile to determine thereat the optimized shape of the surface 48. Six (6) of such design stations positioned along the abscissa of the graph in FIG. 3 are disposed at profile locations graphically measured along the fixed plate surface 46 to indicate passage widths (h) at right angles to the surface 46. Two (2) of the design stations are located between the inlet end 32 of the diffuser passage 34 and the location of the passage pinch point 50, with the remainder of the design stations located between the pinch point 50 and the passage outlet end 42.

Pursuant to the present invention, the designed operating conditions for the diffuser passage 34 are achieved by the aforementioned published calculation procedure based on a constant diffuser passage length and width at the inlet end 32 with an initial fixed convergent profile segment 52 along the shaped shroud surface 48 that is 17% of the fixed diffuser passage length. A composite function (f) of static pressure rise (Cp) and total pressure loss (ω) within passage 34 is used to evaluate performance of the vaneless diffuser 20, by formulations:

$$f(\vec{h})=\beta\omega-\alpha C_p;$$

$$\omega=\frac{p_{t3}-p_{t2}}{1/2\rho_2 U_2^2};$$

and $$C_p=\frac{p_{s3}-p_{s2}}{1/2\rho_2 U_2^2},$$

where:

$h(\vec{h})=(h_i)$, (ordinate measurement in FIG. 3);

i=1 . . . n, n representing the number of design stations as shown in FIG. 3;

$p_{s2}$ and $p_{s3}$ are mass-averaged static pressures at the diffuser passage inlet and outlet ends 32 and 42;

$p_{t2}$ and $p_{t3}$ are mass-averaged total pressures at the inlet and outlet ends 32 and 42; α and β are weighting coefficients; and $\rho_2$ and $U_2$ are respectively fluid density and velocity at the inlet end 32.

The distributions of the static and total pressures along the diffuser passage length are obtained from solving transformed Reynolds-Averaged Navier-Stokes (RANS) equations in curvilinear coordinates:

$$\frac{1}{J}\frac{\partial}{\partial t}(\rho q)=\frac{\partial}{\partial \xi_i}\left(-\rho U_i q+\mu_{eff}G_{ij}\frac{\partial q}{\partial \xi_i}\right)+S_q;$$

where: q represents fluid flow dependent variables;

ρ, J $U_i$, $G_{ij}$ respectively represent fluid density, Jacobian of coordinate transformation, transformed velocities and diffusion metrics; and $\mu_{eff}$ is an effective viscosity representing a sum of laminar viscosity and the turbulent eddy viscosity re-scaled by a turbulence Prandtl or Schmidt number.

Based on the foregoing described calculation procedure, the profile configuration of the shroud surface 48 for the passage 34 of the vaneless diffuser 20 as diagrammed in FIG. 3 compares favorably with that of a conventional compressor; and includes a continuously converging inlet portion between the inlet end and the pinch point of up to 1.35 $r/r_2$ as graphically diagrammed by curve 54 in FIG. 5 which also diagrams the divergent portion 58 between the pinch point and a divergent exit portion. The minimum width ($h/r_2$) of the diffuser passage 34 at the pinch point 50 as diagrammed in FIG. 3 is 0.045, while at the flow exit outlet end 42 the width is 0.053. The calculated static pressure rise is 27.21% of the inlet dynamic diffuser pressure. Additionally, the total pressure loss is 16.43%. The flow of the fluid in passage 34 as diagrammed in FIG. 4 reflects flow separation in a region of reduced size due to a greater convergence of the passage 34 because of the curvature of the shroud surface 48. At the diffuser outlet end 42, the shroud surface curvature profile is such as to direct exit outflow from the passage 34 into the volute discharge passage 44 in a much smoother fashion because of a reduced flow angle that is less than that of the convergent profile segment 52.

Static pressure distributions along the diffuser passage 34 involve slower flow deceleration decreasing the effect of flow separation. However, more rapid overall expansion of flow occurs due to the divergent section 58 of the flow passage 34 along the shroud surface 48 between 1.3 and 1.7 $r/r_2$ as shown in FIG. 5. The decelerating flow of the fluid along such divergent section 58 provides for more efficient static pressure recovery.

Figure 6:
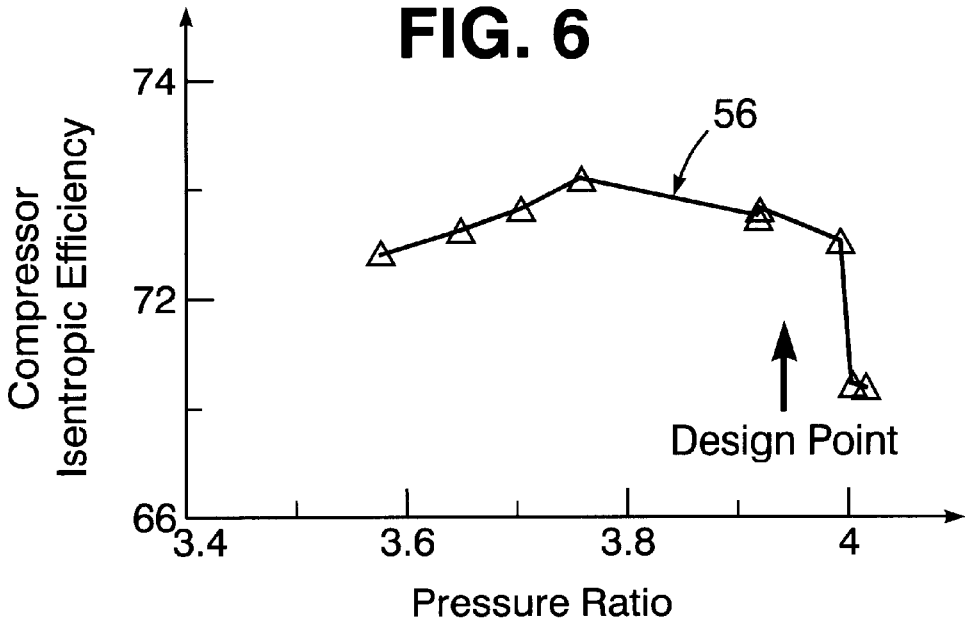
FIG. 6 is a graph showing the relationship between the diffuser pressure rise ratio and efficiency associated with the compressor shown in FIGS. 1 and 2.

Measurements were obtained from tests of the compressor 10 installed in a shipboard air-conditioning system. Such tests were performed with the impeller 14 driven at a speed of 15,160 RPM, with the inflow passage 24 in a fully opened condition and condensing conditions varied to provide measured data for plotting compressor isentropic efficiency versus the ratio of outlet discharge to inlet suction pressure as graphically diagrammed in FIG. 6, reflecting a 3% increase in compressor efficiency attributable to use of the vaneless diffuser 20 designed in accordance with the present invention.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a compressor having power driven impeller means inducing axial inflow of fluid along a rotational axis for outflow directed radially outward into a vaneless diffuser having two surfaces extending radially between inlet and outlet ends of a flow passage of predetermined length formed between said surfaces, the improvement residing in: one of said surfaces having a shape contoured profile extending between the inlet and outlet ends of the flow passage which includes: a pinch point located between the inlet and outlet ends establishing thereat a minimum passage area of the flow passage between the two surfaces; convergent and divergent profile portions respectively extending from the inlet end to the pinch point and from the pinch point toward the outlet end; and an exit portion of the flow passage extending between said divergent profile portion and the outlet end at an outflow angle smoothing outflow discharge from the outlet end.

2. The combination as defined in claim 1, wherein said outflow discharge enters a circumferentially divergent volute passage.

3. The combination as defined in claim 2, wherein said fluid is refrigerant.

4. The combination as defined in claim 3, wherein said convergent profile portion includes an initial segment extending from the inlet end at an inflow angle greater than that of the outflow angle at the outlet end.

5. The combination as defined in claim 1, wherein said fluid is refrigerant.

6. The combination as defined in claim 1, wherein said convergent profile portion includes an initial segment extending from the inlet end at an inflow angle greater than that of the outflow angle at the outlet end.

7. The combination as defined in claim 6, wherein said initial segment of the convergent profile portion is 17% of said predetermined length of the flow passage.

* * * * *